US006641213B1

(12) United States Patent
Kuhn

(10) Patent No.: US 6,641,213 B1
(45) Date of Patent: Nov. 4, 2003

(54) SEAT ATTACHMENT FOR DESKS

(76) Inventor: Lloyd Kuhn, 620 Oak Rd., Kemah, TX (US) 77565

( * ) Notice: Subject to any disclaimer, the term of this patent is extended or adjusted under 35 U.S.C. 154(b) by 0 days.

(21) Appl. No.: 10/072,515

(22) Filed: Feb. 12, 2002

(51) Int. Cl.[7] ..... A47C 1/08

(52) U.S. Cl. ..... 297/250.1; 297/138; 297/141; 297/142; 108/48

(58) Field of Search ..... 297/250.1, 134, 297/135, 138, 141, 142, 143, 147, 14, 256.1; 108/152, 42, 48

(56) References Cited

U.S. PATENT DOCUMENTS

| | | | | |
|---|---|---|---|---|
| 111,782 | A | * | 2/1871 | Sexton |
| 371,168 | A | * | 10/1887 | Boss |
| 540,515 | A | * | 6/1895 | Rowlett |
| 1,043,450 | A | * | 11/1912 | Morse |
| 1,288,604 | A | * | 12/1918 | Jenkins |
| 1,304,368 | A | * | 5/1919 | Purcell |
| 2,245,951 | A | * | 6/1941 | Agee |
| 4,406,495 | A | | 9/1983 | Turner |
| 4,736,998 | A | | 4/1988 | Wilson et al. |
| 5,590,927 | A | * | 1/1997 | Rapphahn |
| 5,685,602 | A | | 11/1997 | Williams |
| 5,876,093 | A | | 3/1999 | Williams |
| 5,927,835 | A | | 7/1999 | Mergold et al. |
| 6,010,186 | A | | 1/2000 | Tsay |

* cited by examiner

*Primary Examiner*—Laurie K. Cranmer
(74) *Attorney, Agent, or Firm*—Kenneth A. Roddy

(57) ABSTRACT

A seat attachment for attachment to the side of a desk has a retractable support arm with a seat at one end that is movable between a stored position closely adjacent to the side of the desk and an outwardly extended deployed position to provide an auxiliary seating surface. In a first embodiment, the support arm is slidably received in a generally rectangular outer housing secured horizontally to the side of the desk, and is movable relative thereto between a stored position within the outer housing and an outwardly extended position disposed horizontally a distance above the surface of a floor. In a second embodiment, a support arm is pivotally connected to a generally rectangular outer housing secured vertically to the side of the desk, and is movable relative thereto between a stored position within the outer housing and an outwardly pivoted extended position disposed horizontally a distance above the surface of a floor. In both embodiments, a support leg member is pivotally connected with the support arm and movable relative thereto between a stored position within the support arm and an outwardly extended vertical position generally perpendicular to the support arm.

11 Claims, 8 Drawing Sheets

SEAT ATTACHMENT FOR DESKS

BACKGROUND OF THE INVENTION

1. Field of the Invention

This invention relates generally to desks and seating apparatus, and more particularly to a seat attachment for desks having an outer tubular or channel member that attaches to the side of a desk and a support arm movably mounted therein with a seat member at an outer end thereof, wherein the support arm is movable between a retracted stored position and an outwardly extended position with the support arm seat supported horizontally a distance above the floor to provide temporary auxiliary seating.

2. Brief Description of the Prior Art

The present invention is a solution to the limited space problem that is common in modern offices and dwellings. In many modern offices, people work in small cubicles which are equipped with a desk and a chair for the person using the desk. However, due to the limited size of the cubicle, there is often no room for storing a guest chair which would allow a second person or guest to sit adjacent to the desk while conversing with the person seated at the desk. Desks are also commonly located in various small rooms in apartments and dwellings where the room is required to serve as a home office, workroom, dining room, or bedroom, and may also contain bookshelves, or other large pieces of furniture or appliances.

Folding tables, folding chairs, and foldable or collapsible desk and chair combinations are known in the prior art. However, they do not solve the problem accomplished by the present invention. Most prior art folding tables and chairs must be purchased as a separate set of furniture and stowed away in the small room or a closet, and retrieved when needed. These types of table and chair arrangements would not be suitable for use in small cubicles in offices or in small rooms of a dwelling that are already equipped with a desk. Most prior art collapsible desk and chair combinations provide the desk and chair as an integral unit. Thus, these collapsible desk and chair combinations require the user to replace their existing desk with the combination. These prior art combinations are also not particularly suitable for use as office furniture.

Turner, U.S. Pat. No. 4,406,495 discloses a foldable bench assembly that attaches to the side of a structure. The bench assembly includes a seat, a pair of legs swingably attached to the underside of the seat, and telescoping inner and outer round tubes that are also rotatable with respect to each other. The inner tube is pivotally connected at one end to a side of the structure near its bottom end, and the outer tube is attached at its outer end to the seat such that the seat can pivot relative to the outer tube and also rotate about the longitudinal axis of the tubes. An L-shaped upper bracket is attached to the same side of the structure diagonally across and at a height above the pivotal connection of the inner tube, and a clamp is attached to the structure vertically above the pivotal connection. In the deployed position, the tubes extend angularly forward and upward from the lower pivotal connection and are supported at their upper ends on the L-shaped bracket and the seat is disposed horizontally supported on the legs. The bench is moved to a vertical stored position on the side of the structure by swinging the legs under the seat, rotating the seat and folded legs from a horizontal to a vertical position, then swinging the whole assembly including the tubes about the lower pivotal connection of the inner tube and engaging the legs in the clamp, such that the seat and folded legs are disposed at the upper end of the structure vertically above the pivotal connection.

Mergold et al, U.S. Pat. No. 5,927,835 discloses an article of furniture having a desk part with an inner space, a chair part pivotally connected to the desk part around a substantially vertical axis between an operative position in which the chair part is spaced from the desk part so that a user can sit on the seat part, and an inoperative position in which the chair part is introduced into the interior of the desk part to form a compact and substantially peripherally closed unit.

Tsay, U.S. Pat. No. 6,010,186 discloses a combination desk and chair that includes two pairs of foldable legs with a desk surface supported thereon and the chair has two legs pivotally extending from the underside thereof. A pair of telescoping inner and outer tubes are connected between the chair and the legs of the desk so that the distance between the desk and the chair is adjustable. The foldable legs of the desk and the chair with the legs thereof are foldable to make the combination desk and chair have a compact size.

Williams, U.S. Pat. No. 5,876,093 discloses a collapsible desk and chair apparatus that includes a one-piece desk member having two pairs of support legs pivotally connected thereto and to one another and a seat unit pivotally connected to both the desk member and one of the pairs of support legs. A seat reinforcement unit operatively connected between the seat unit and one of the pairs of support legs comprises a pair of telescoping sleeve elements which rotate a latch cam element during the extension and retraction phases.

Williams, U.S. Pat. No. 5,685,602 discloses a collapsible desk and chair apparatus that includes a one-piece desk member having two pairs of support legs pivotally connected thereto and to one another and a seat unit pivotally connected to both the desk member and one of the pairs of support legs. The other pair of support legs are both pivotally and moveably connected to the underside of the desk member.

Wilson et al, U.S. Pat. No. 4,736,998 discloses a compact workbench in which the seat is disposed at the outer ends of a pair of parallel rails and the seat and rails are nestable within a cabinet-like base. In a first embodiment, the rails are pivotally connected to the workbench at one end so that the seat and rails pivot into the cabinet-like base, and in a second embodiment, the rails are telescopically connected so that the seat and rails slide into the cabinet-like base.

The present invention is distinguished over the prior art in general, and these patents in particular by a seat attachment for attachment to the side of a desk that has a retractable support arm with a seat at one end and which is movable between a stored position closely adjacent to the side of the desk and an outwardly extended deployed position to provide an auxiliary seating surface. In a first embodiment, the support arm is slidably received in a generally rectangular outer housing secured horizontally to the side of the desk, and is movable relative thereto between a stored position within the outer housing and an outwardly extended position disposed horizontally a distance above the surface of a floor. In a second embodiment, a support arm is pivotally connected to a generally rectangular outer housing secured vertically to the side of the desk, and is movable relative thereto between a stored position within the outer housing and an outwardly pivoted extended position disposed horizontally a distance above the surface of a floor. In both embodiments, a support leg member is pivotally connected with the support arm and movable relative thereto between a stored position within the support arm and an outwardly extended vertical position generally perpendicular to the support arm.

SUMMARY OF THE INVENTION

It is therefore an object of the present invention to provide an auxiliary seat attachment that can be easily and quickly installed on the side of a desk to provide temporary auxiliary seating.

It is another object of this invention to provide a seat attachment for desks that is particularly useful in compact quarters.

Another object of this invention is to provide a seat attachment for desks that is movable between a retracted stored position closely adjacent to the side of the desk and an outwardly extended position to support an auxiliary seat a distance above the floor.

Another object of this invention is to provide an auxiliary seat attachment which, when installed on the side of a desk, will not detract from the decor of the room or workspace in which it is used.

A further object of this invention is to provide an auxiliary seat attachment for desks, which does not require the purchase of a desk unit.

A further object of this invention is to provide an auxiliary seat attachment for desks that is simple in construction, inexpensive to manufacture, and rugged and reliable in operation Other objects of the invention will become apparent from time to time throughout the specification and claims as hereinafter related.

The above noted objects and other objects of the invention are accomplished by a seat attachment for attachment to the side of a desk which has a retractable support arm with a seat at one end that is movable between a stored position closely adjacent to the side of the desk and an outwardly extended deployed position to provide an auxiliary seating surface. In a first embodiment, the support arm is slidably received in a generally rectangular outer housing secured horizontally to the side of the desk, and is movable relative thereto between a stored position within the outer housing and an outwardly extended position disposed horizontally a distance above the surface of a floor. In a second embodiment, a support arm is pivotally connected to a generally rectangular outer housing secured vertically to the side of the desk, and is movable relative thereto between a stored position within the outer housing and an outwardly pivoted extended position disposed horizontally a distance above the surface of a floor. In both embodiments, a support leg member is pivotally connected with the support arm and movable relative thereto between a stored position within the support arm and an outwardly extended vertical position generally perpendicular to the support arm.

DESCRIPTION OF THE PREFERRED EMBODIMENT

Figure 1:
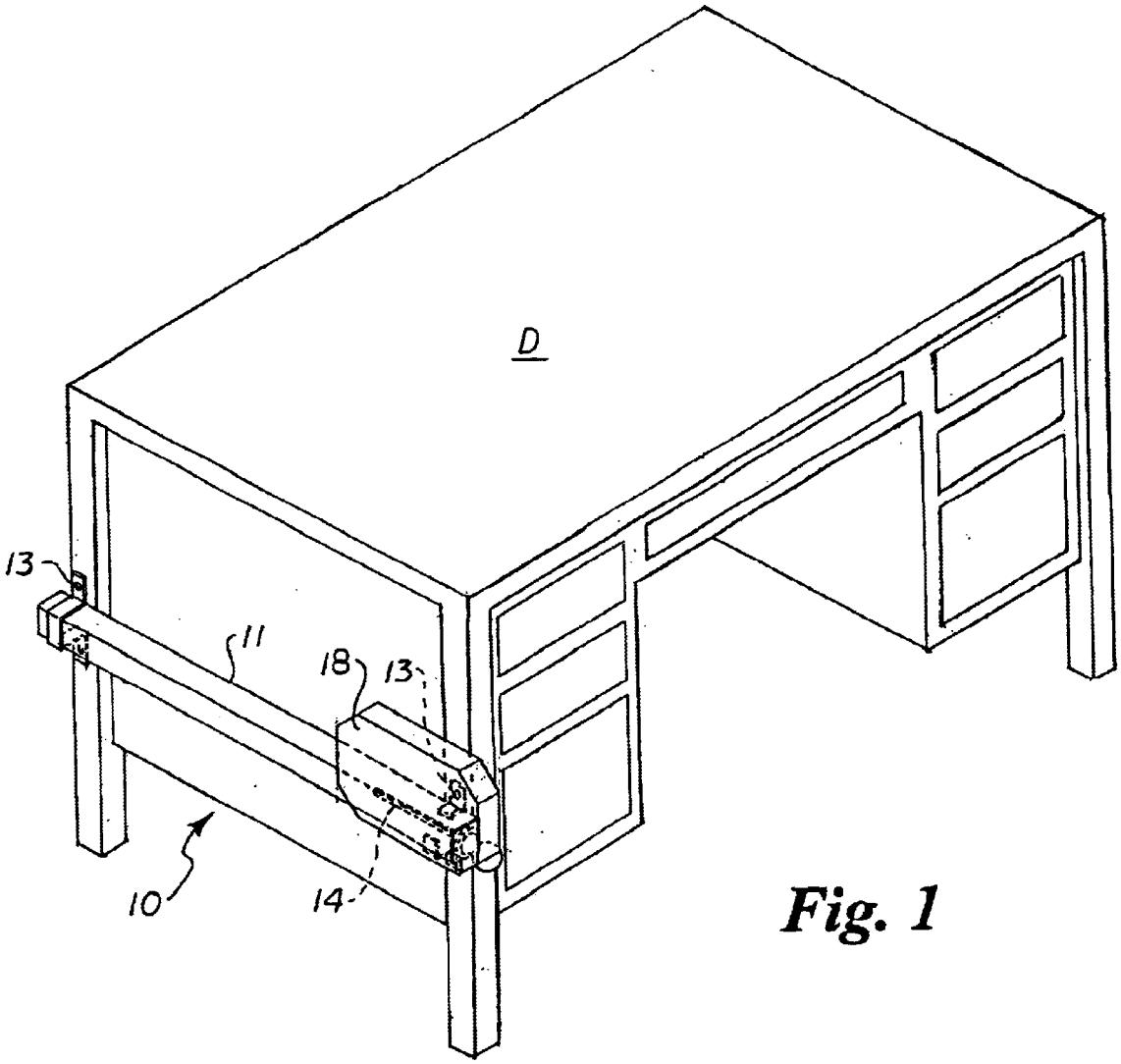
FIG. 1 is a perspective view of the seat attachment for desks in accordance with the present invention, shown attached to the side of the desk with the seat in a retracted position.
Figure 2:
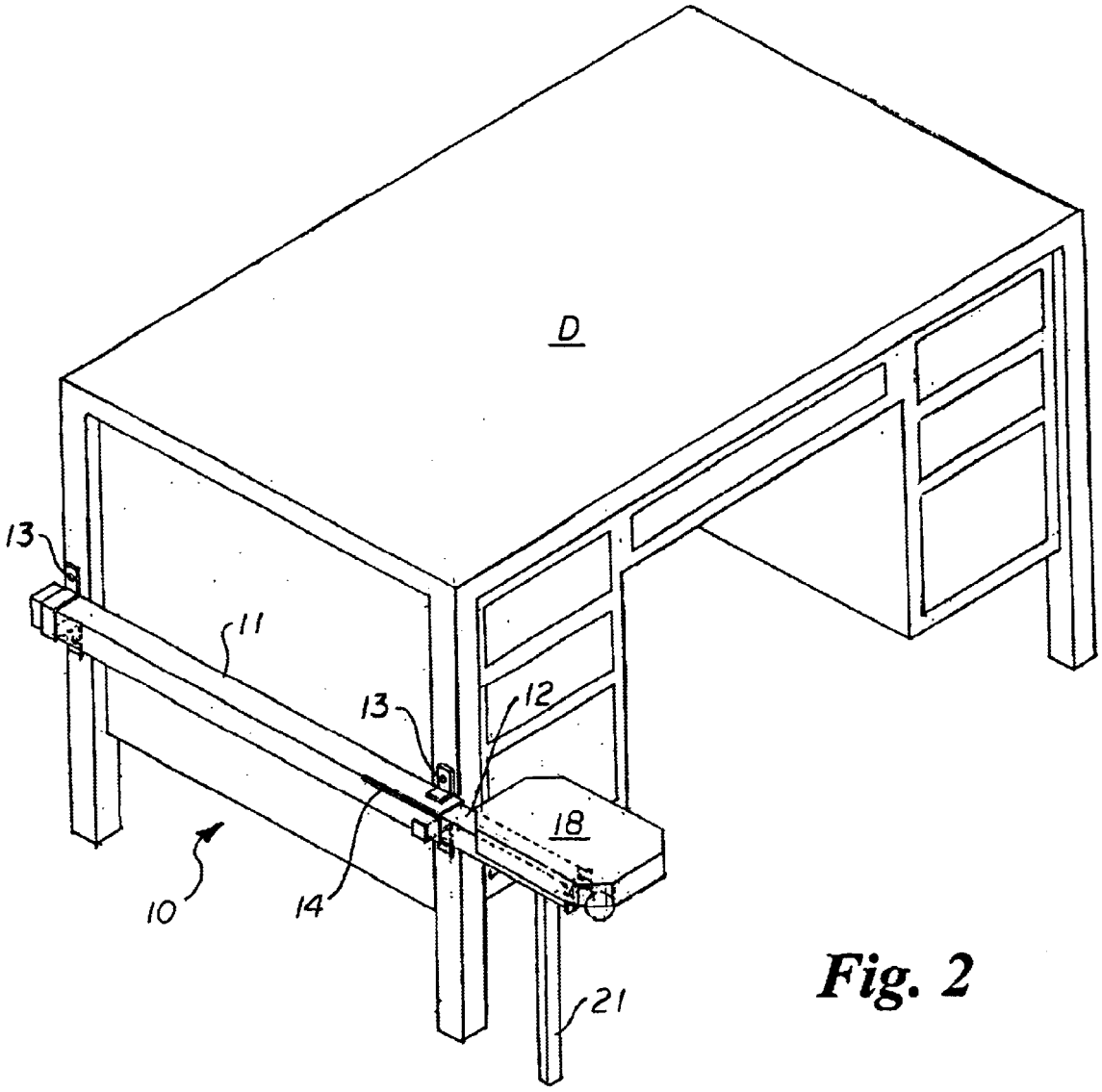
FIG. 2 is a perspective view of the seat attachment for desks, shown attached to the side of the desk with the seat in an extended and deployed position ready for use.
Figures 3, 4:
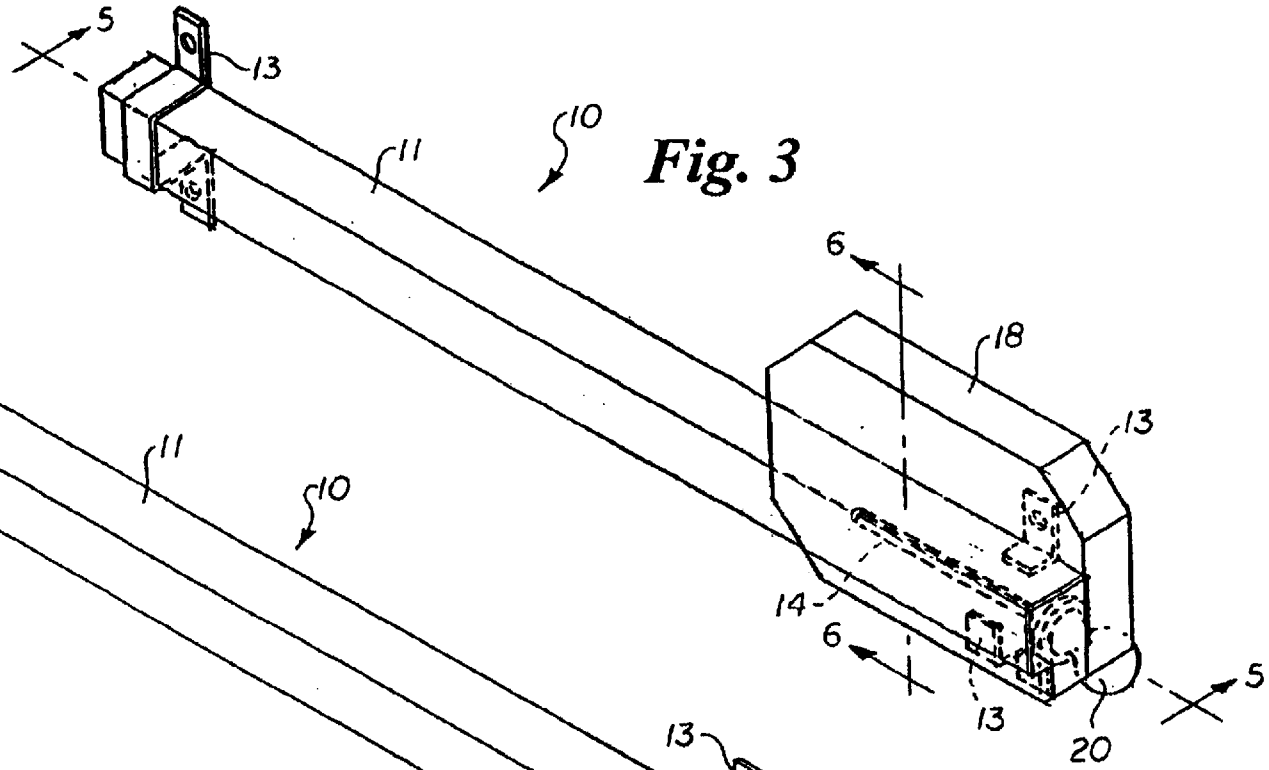
FIG. 3 is a perspective view of the seat attachment for desks, shown the retracted position.
FIG. 4 is a perspective view of the seat attachment for desks, shown in the extended and deployed position.

Referring to the drawings by numerals of reference, there is shown in FIGS. 1 through 4, a preferred seat attachment 10 in accordance with the present invention. FIGS. 1 and 2 show the seat attachment 10 attached to the side of a desk D with the seat in a retracted position and an extended position, respectively. FIGS. 3 and 4 show the seat attachment 10 in somewhat larger scale in the retracted and extended position, respectively.

The seat attachment 10 has an elongate tubular outer housing member 11, preferably formed of square tubing, and an elongate inner support arm 12 slidably mounted therein. The length of the outer tubular member 11 is sufficient to extend horizontally across the width of the desk D a distance beneath the top of the desk. The outer tubular housing 11 is attached to the side of the desk D by brackets 13 at each end of the outer housing. It should be understood that the brackets 13 may be integral with the outer housing 11. The back end of the outer tubular housing 11 is enclosed by an end plate 11A. One top corner of the outer tubular housing 11 is cut away to form a longitudinal slot 14 that extends longitudinally a distance inwardly from the open front end.

Figures 5, 7:
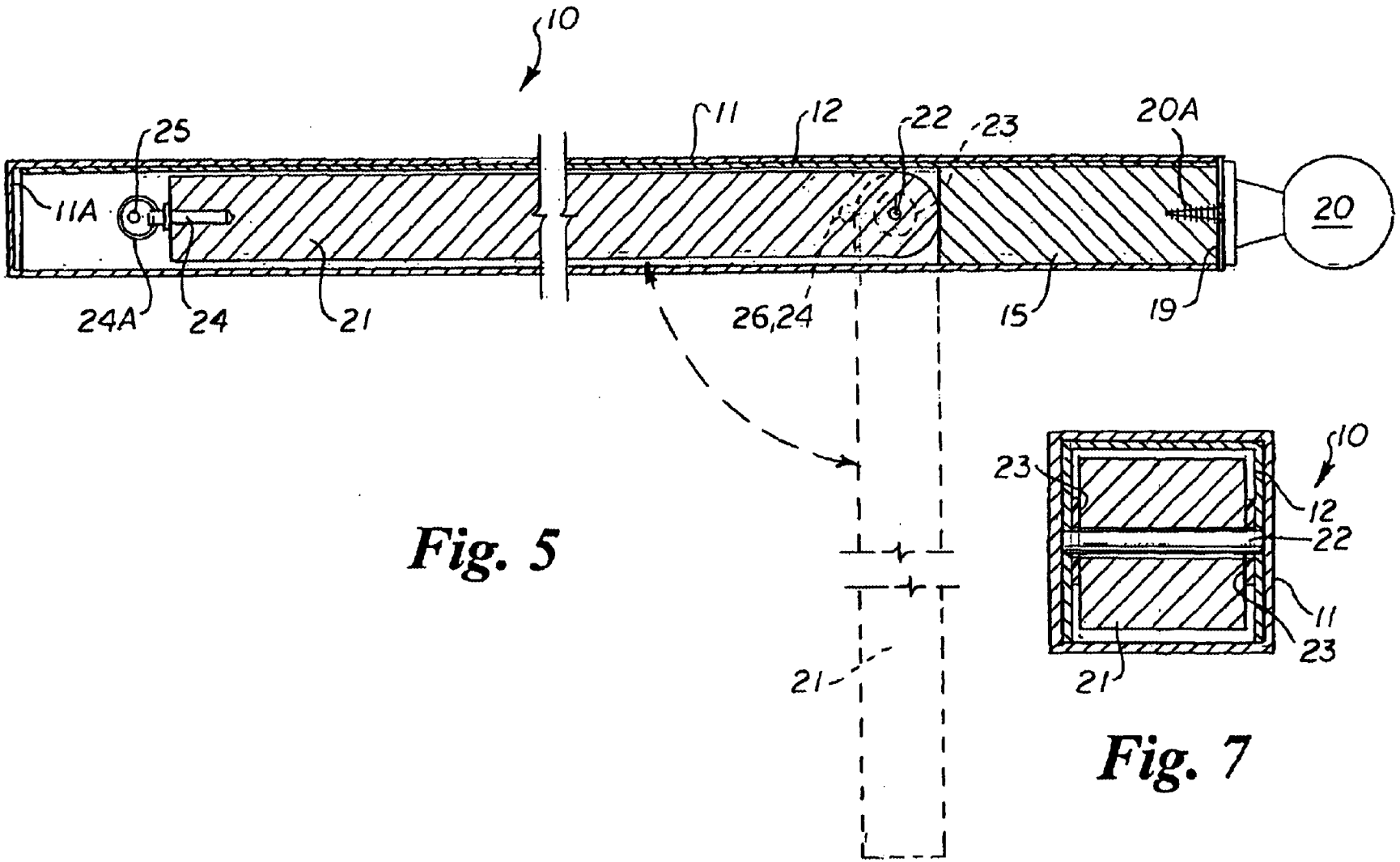
FIG. 5 is a longitudinal cross section taken along line 5—5 of FIG. 3, showing the seat and arm in the retracted position with the support leg disposed in the arm and which is shown deployed dashed line.
FIG. 7 is a transverse cross section through the pivot connection of the support leg and support arm.
Figure 6:
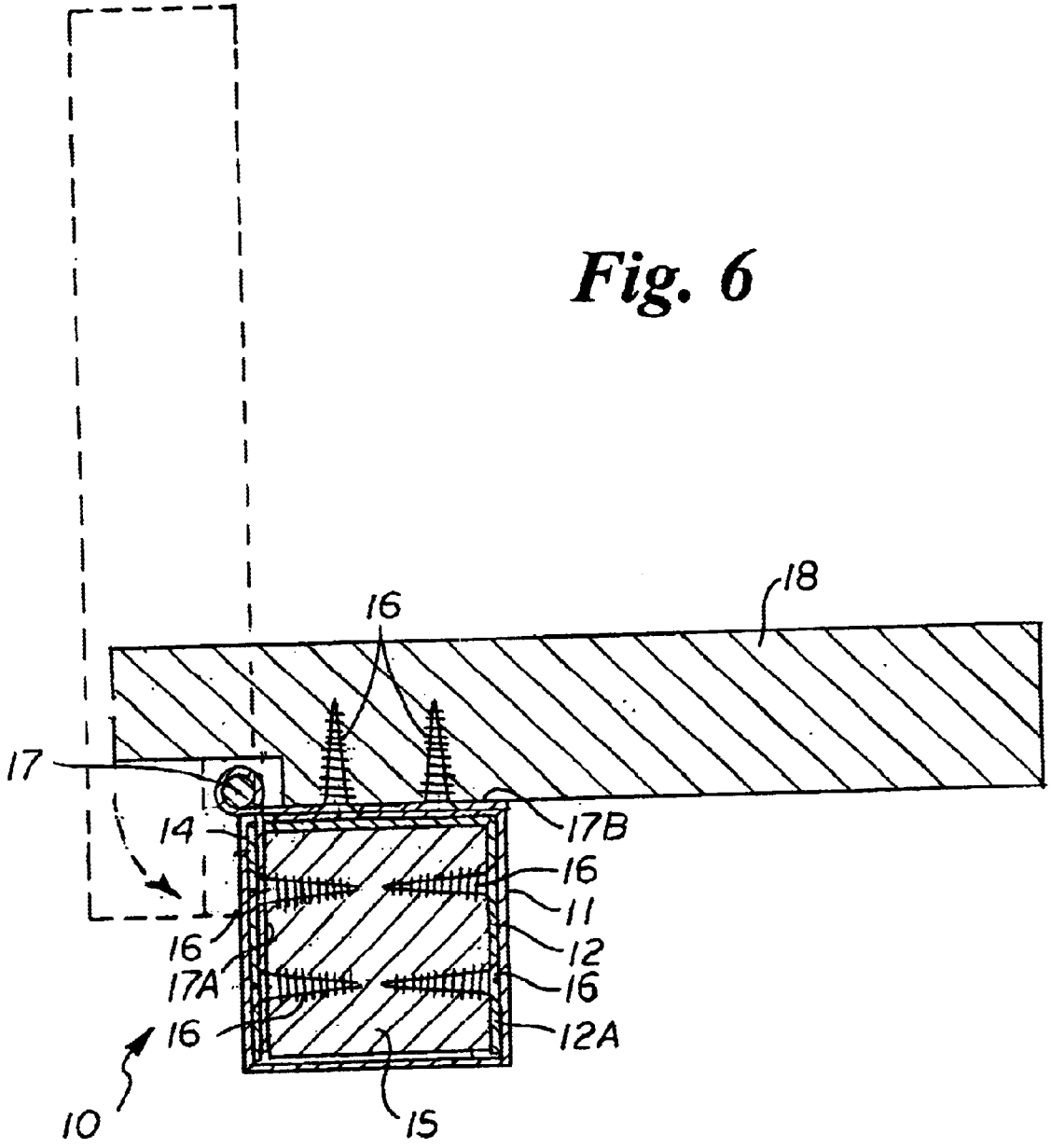
FIG. 6 is a transverse cross section taken along line 6—6 of FIG. 3, showing the seat in a raised position in dashed line and in a horizontal deployed position in solid line.

As best seen in FIGS. 5, 6 and 7, the inner support arm 12 is an elongate inverted generally square U-shaped channel with the open side of the channel facing downwardly. A generally rectangular mounting block 15 is disposed in the interior of the support arm 12 at its outer end and secured at a first side to one lateral side 12A of the support arm by screws 16 or other suitable fastener means. A hinge 17 has one leg 17A secured to the opposed side of the mounting block 15 and its other leg 17B is secured to the underside of a rigid seat member 18 by screws 16 or other suitable fastener means. It should be understood that the top of the seat 18 may be padded and covered by upholstery. The hinged seat 18 pivots between a horizontal deployed position as shown in solid line and a generally vertical raised position as shown in dashed line (FIG. 6).

As best seen in FIG. 5, an end plate 19 covers the front end of the support arm 12 and a knob 20 having a threaded shank 20A passing through the center of the end plate is secured to the mounting block 15. The knob 20 has a rounded outer end that may be grasped by the user to slide the support arm 12 longitudinally inward and outward relative to the outer tubular housing 11 between a retracted position and an extended position.

To move the support arm 12 to the retracted position, the seat 18 is pivoted upwardly and the support arm is pushed inwardly relative to the outer tubular housing 11. As the support arm 12 moves inwardly, the leg 17A of the hinge 17 passes into the slot 14. When the support arm 12 is in the innermost retracted position, the seat 18 remains in a generally vertical position and/or may be supported against the outer surface of the side of the desk D.

To move the support arm 12 to the extended position, the support arm is pulled outwardly relative to the outer tubular housing 11, and the seat 18 is pivoted downwardly to a horizontal position with the leg 17B of the hinge 17 and underside of the seat 18 supported on the top surface of the support arm 12.

Referring now to FIGS. 2, 5 and 7, a retractable support leg 21 may be disposed in the interior of the support arm 12. The support leg 21 is an elongate rectangular member pivotally connected at one end to the laterally opposed sides of the support arm 12 by a pivot pin 22. A pair of washers 23 may be installed between the laterally opposed sides of the support leg 21 and support arm 12 (FIG. 7). A latch pin 24 is removably mounted in the free end of the support leg 21 and has a ring 24A that is releasably engaged on a pin 25 extending transversely a distance inward from one lateral side of the support arm 12. In the retracted position, the support leg 21 is supported in a generally horizontal position inside the support arm 12 by the pivot pin 22 at its front end and the ring 24A of the latch pin 24 at its back end.

To deploy the support leg 21, the support arm 12 is pulled outwardly relative to the outer tubular housing 11, the ring 24A of the latch pin 24 is removed from the inward facing pin 25, the latch pin is removed from the support leg, and the support leg is pivoted downwardly into a vertical position. The latch pin 24 is then installed transversely through holes 26 in the lateral sides of the outer tubular housing 11 to lock the support leg 21 into its vertical position. The process is reversed to retract and store the support leg 21 when not in use.

It should be understood that the seat 18 may be used without deploying the support leg 21 when the seat is positioned fairly close to the desk, but is some instances, when the seat is disposed a greater distance from the desk, the support leg may be deployed to provide additional support. It should also be understood that the support arm 12 may be made in a first longer rear section and a second shorter front section and provided with a pivot joint between the two sections, such that shorter front section and the seat may be pivoted in a horizontal plane, about a vertical axis to position it at selected angular positions relative to the desk. In that modification, the shorter front section contains the mounting block, end plate and knob as described above, and the support leg would be deployed to allow the pivoting movement.

Figure 8:
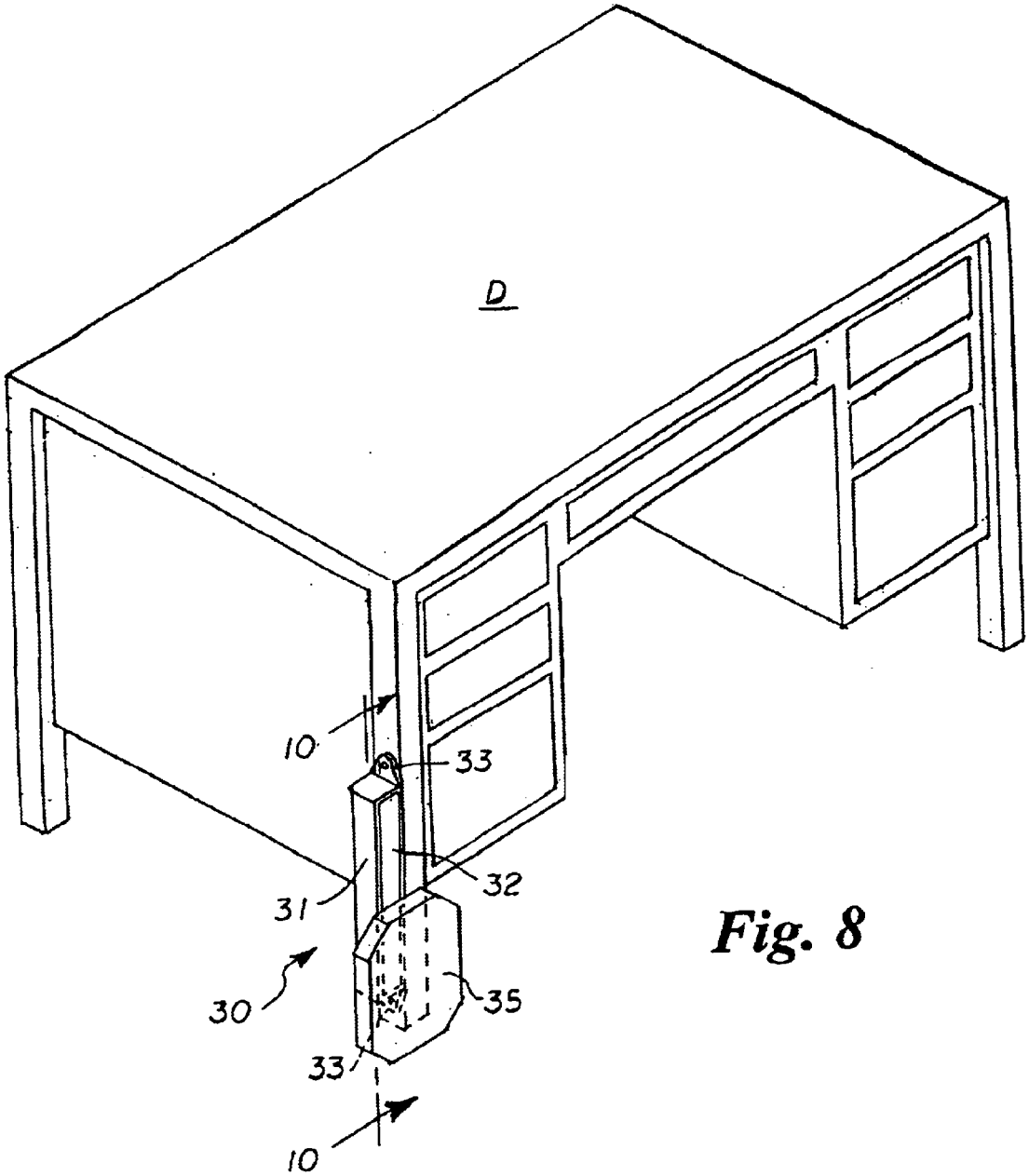
FIG. 8 is a perspective view of a second embodiment of the seat attachment for desks, shown attached to the side of the desk in a retracted stored position.
Figure 9:
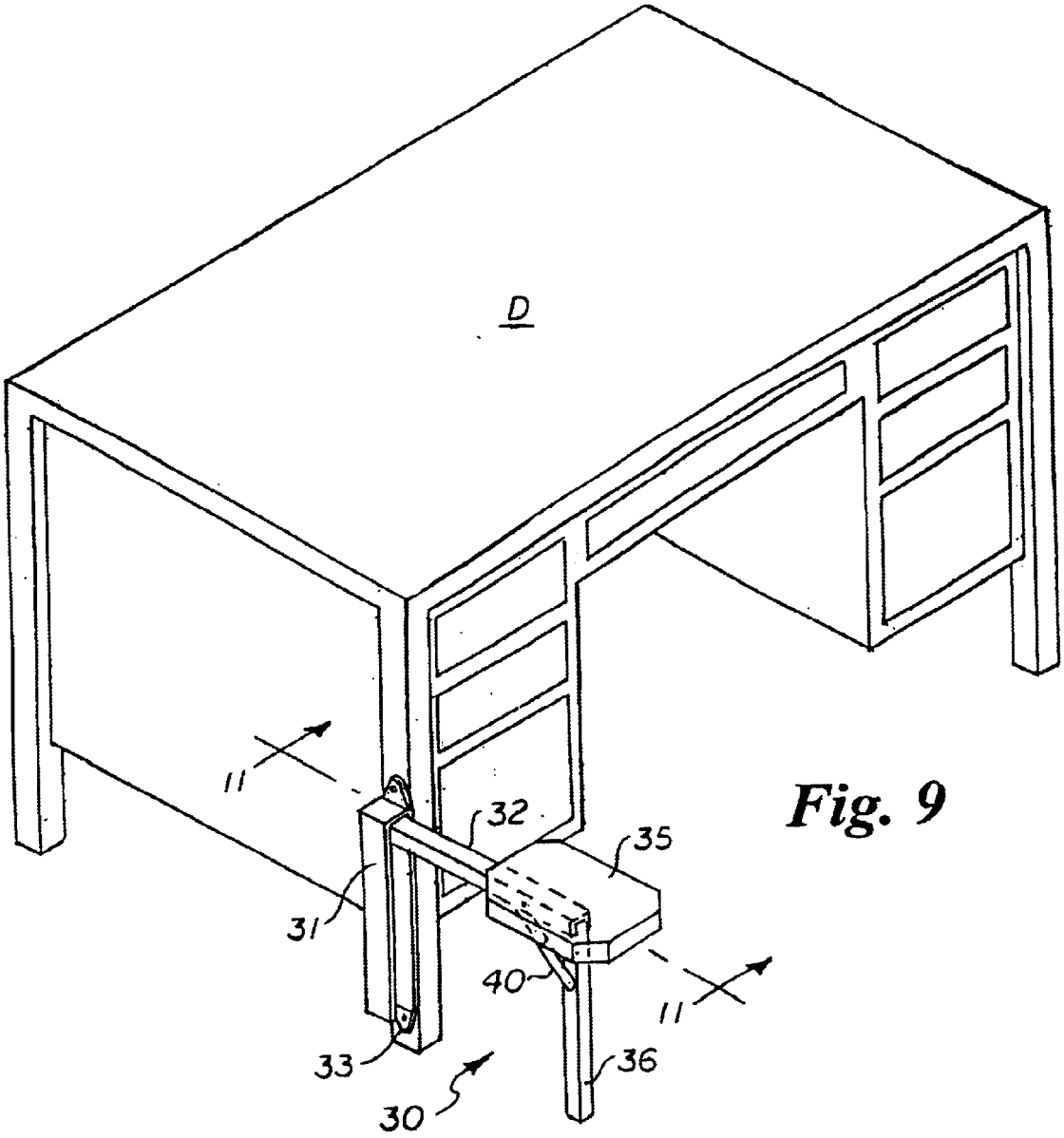
FIG. 9 is a perspective view of the seat attachment embodiment of FIG. 8, shown attached to the side of the desk in an extended and deployed position ready for use.
Figure 11:
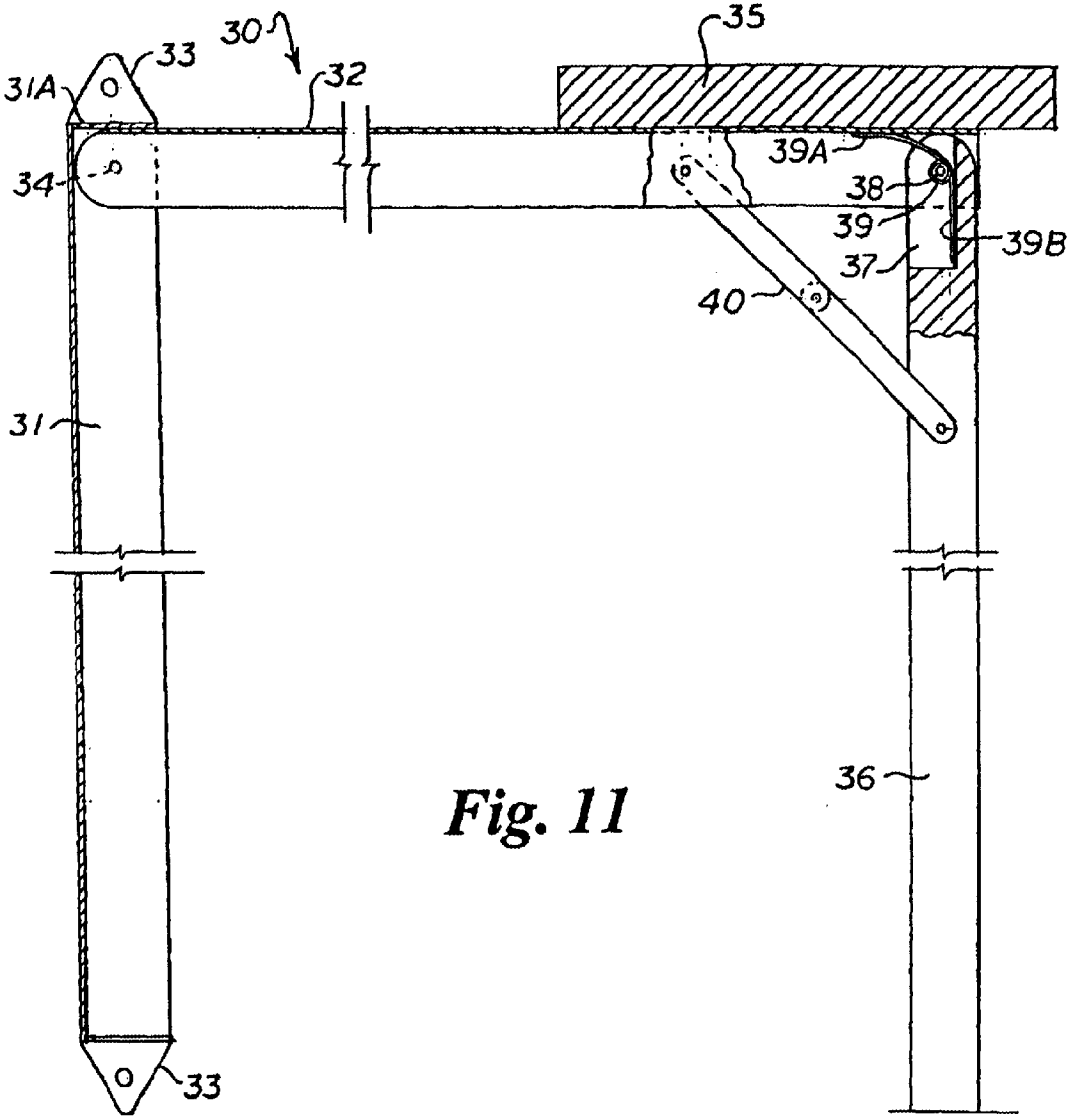
FIG. 11 is a transverse cross section taken along line 11—11 of FIG. 8, showing the seat and support arm in a raised horizontal deployed position.
Figure 10:
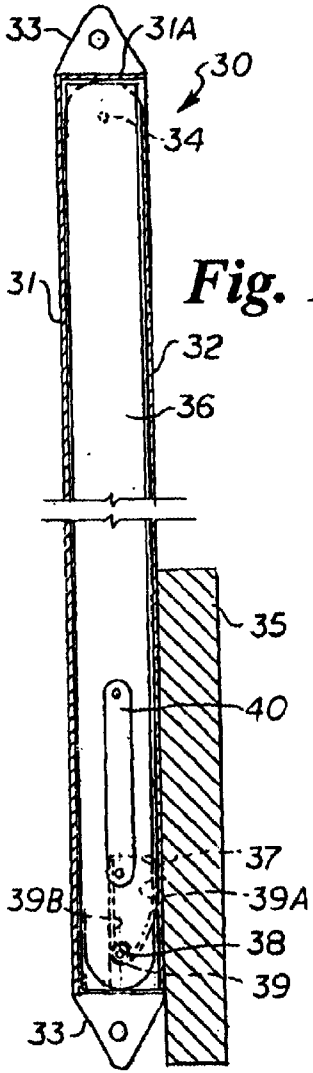
FIG. 10 is a longitudinal cross section taken along line 10—10 of FIG. 8, showing the seat, the support arm and the support leg in the retracted position.

FIGS. 8 through 11 illustrate a second embodiment of the seat attachment 30 for desks that is mounted vertically on the side of the desk. FIGS. 8 and 9 show the seat attachment 30 attached to the side of a desk D with the seat in a stored position and an extended position, respectively. FIGS. 10 and 11 show the seat attachment 30 in longitudinal cross section in the retracted and extended position, respectively.

The seat attachment 30 has an elongate outer channel member 31, having a generally square U-shaped transverse cross section, and an elongate inner support arm channel 32, having an inverted generally square U-shaped transverse cross section, pivotally mounted therein in opposed facing relation. The outer channel member 31 is mounted vertically along the front leg or side of the desk D a distance beneath the top of the desk by screws or other conventional fasteners installed through holes in extensions 33 at each end of the outer channel member. The top end of the outer channel member 31 is enclosed by an end plate 31A.

As best seen in FIGS. 10 and 11, the upper end of the lateral sides of the inner support arm channel 32 are pivotally connected to the upper end of the lateral sides of the outer channel 31 by a pair of transverse pivot pins 34. A seat member 35 is secured to the outer side of the support arm channel 32 near its free end. It should be understood that the top of the seat 35 may be padded and covered by upholstery. The inner support arm channel 32 and seat 35 pivot as a unit between vertical stored position (FIGS. 8 and 10) and a horizontal deployed position (FIGS. 9 and 11).

A support leg 36 is movably disposed in the interior of the support arm channel 32. The support leg 36 is an elongate rectangular member having a longitudinal slot 37 extending inwardly a distance from one end along its inner facing side. The support leg 36 is pivotally mounted at the lower end of the support arm channel 32 by a pivot pin 38 extending transversely through the slot 37 and lateral sides of the support arm channel. A torsion spring 39 disposed on the slot 37 is coiled about the pivot pin 38 and has one leg 39A engaged on the underside of the support arm channel 32 and its other leg 39B engaged on the bottom surface of the slot, to normally urge the support leg to an outwardly extended position.

A conventional elbow brace or link 40 has one end pivotally mounted on one side of the support leg 36 and its opposed end pivotally mounted on one inner side of the support arm channel 32. In a collapsed or folded position, the elbow brace or link 40 is disposed in a space between the side lateral side of the support leg 36 and inner side of the support arm channel 32 parallel therewith. When the support leg 36 is pivoted outwardly to a vertical position perpendicular to the support arm 32, the elbow brace or link 40 is unfolded and extends diagonally between the support leg and support arm channel to maintain the support leg in the perpendicular position. The elbow brace or link 40 may be of the conventional type having a break-over-center pivot joint which is released by pushing upwardly on the pivot joint.

When the seat attachment 30 is in the retracted or folded position, the support leg 36 is disposed vertically inside the support arm channel 32 and the support arm channel is disposed vertically inside the outer channel member 31 (FIG. 10).

To deploy the seat attachment, the free lower end of the support arm channel 32 is pivoted upwardly about the pivot pin 34 to assume a horizontal position. As the support arm channel 32 assumes its horizontal position, the torsion spring 39 urges the free end of the support leg 36 to pivot outwardly and downwardly about the pivot pin 38 to assume a vertical position perpendicular to the support arm channel. As the support leg 36 assumes its vertical position, the elbow brace or link 40 unfolds to its diagonal position to lock the support leg 36 in its vertical position. The seat 35 at the outer end of the support arm channel 32 is disposed in a horizontal position a distance above the surface of the floor.

To move the seat attachment 30 back to its retracted or folded position, the center of the elbow brace or link 40 is pushed upwardly and the lower end of the support leg 36 is pivoted upwardly against the resistance of the torsion spring 39 until it is disposed inside of the support arm channel 32. The outer end of the support arm channel 32 is then pivoted downwardly until it enters the outer channel member 31. The seat 35 is then disposed in its vertical stored position.

It should be understood that, alternatively, the extensions 33 may extend from the back side of the outer channel member 31 so that the outer channel member can be installed on the leg or side of the desk with the support arm channel 32 and facing laterally outward from the side of the desk, such that the support arm and seat 35 would be extended laterally outward from the side of the desk.

While this invention has been described fully and completely with special emphasis upon preferred embodiments, it should be understood that within the scope of the appended claims the invention may be practiced otherwise than as specifically described herein.

What is claimed is:

1. A seat attachment for attachment to the side of a desk and having a seat movable between a stored position closely adjacent to the side of the desk and a deployed position to provide an auxiliary seating surface, comprising:

an elongate generally rectangular outer channel member having a generally square U-shaped transverse cross section adapted to be secured vertically to the side of a desk with an open side perpendicular to the side of the desk;

an elongate inner support arm channel having a generally square U-shaped transverse cross section nested vertically within said outer channel member in opposed facing relation in a stored position, and having a first end pivotally connected with an upper end of said outer channel member and a second end pivotal outwardly and upwardly from said outer channel member to an outwardly extended position disposed horizontally a distance above the surface of a floor;

a seat is secured to said support arm channel second end; and an elongate support leg member nested vertically within said support arm channel in a stored position, having a first end pivotally connected with said second end of said support arm channel and having a second end pivotal outwardly and downwardly from said support arm channel to an outwardly extended vertical position;

in the stored position, said support leg member disposed vertically inside said support arm channel and said support arm channel disposed vertically inside said outer channel member; and to deploy said seat attachment, said second end of said support arm channel and said seat is pivoted upwardly to assume a horizontal position perpendicular to said outer channel member, and said second end of said support leg is pivoted outwardly and downwardly from said support arm channel to assume a vertical position perpendicular to said support arm channel.

2. The seat attachment according to claim 1, further comprising:

torsion spring means connected between said support leg member and said support arm channel to urge said support leg second end to pivot outwardly and downwardly about the pivotal connection of its said first end with said support arm channel as said support arm channel is pivoted upwardly to assume a horizontal position.

3. The seat attachment according to claim 1, further comprising:

foldable brace means having opposed ends connected between said support leg member and said support arm channel and movable between a folded position generally parallel with said support leg member and said support arm channel in their stored position and an unfolded position extending generally diagonally therebetween in their deployed position to releasably lock and brace said support leg member in a position perpendicular to said support arm channel.

4. A seat attachment for attachment to the side of a desk and having a seat movable between a stored position closely adjacent to the side of the desk and a deployed position to provide an auxiliary seating surface, comprising:

an elongate generally rectangular outer tubular member having a generally square transverse cross section adapted to be secured horizontally to the side of a desk with an open end perpendicular to the side of the desk;

elongate inner support arm channel having a generally square U-shaped transverse cross section received within said outer tubular member in said a stored position with an open side facing downwardly, and slidable a distance outwardly relative thereto in said to an outwardly extended position disposed horizontally a distance above the surface of a floor;

a seat pivotally connected to an outwardly extensible end of said support arm channel to pivot between a generally vertical position and a horizontal deployed position; and an elongate support leg an elongate member sized to be nested generally horizontally within said support arm channel in said stored position, having a first end pivotally connected with said support arm channel and having a second end pivotal outwardly and vertically downwardly from and generally perpendicular to said support arm channel in its said outwardly extended position to engage a floor surface and support said support arm channel and said seat a distance above the surface of the floor;

in the stored position, said support leg member disposed horizontally inside said support arm channel and said support arm channel disposed horizontally inside said outer tubular member; and to deploy said seat attachment, said support arm channel and said seat is pulled outwardly a distance from said outer tubular member to assume a horizontal position coaxial with said outer tubular member, said second end of said support leg member is pivoted outwardly and downwardly from said support arm channel to assume a vertical position perpendicular to said support arm channel, and said seat is pivoted from its generally vertical position to its horizontal deployed position.

5. The seat attachment according to claim 4, wherein said seat is pivotally connected to said outwardly extensible end of said support arm channel by hinge means; and said support arm channel has a slot extending longitudinally from its said open end configured to slidably accommodate said hinge means when said support arm channel is received within said outer tubular member in said stored position.

6. The seat attachment according to claim 4, further comprising:

a latch pin removably mounted in said second end of said support leg member and having a ring releasably connected with said support arm channel to support said support leg member, horizontally inside said support arm channel;

said latch pin is removed from said support leg member after said support arm member channel is pulled outwardly, and after said support leg member is pivoted downwardly into a vertical position, said latch pin is installed transversely through holes in lateral sides of said outer tubular member to lock said support leg member into its said vertical position, and the procedure is reversed to retract and store said support leg member when not in use.

7. A desk having a seat attachment on a side of the desk with a seat movable between a stored position closely adjacent to the side of the desk and a deployed position to provide an auxiliary seating surface, comprising:

a desk having at least one side and supported on a floor surface;

an elongate generally rectangular outer channel member having a generally square U-shaped transverse cross section disposed vertically on said side of said desk with an open side perpendicular to said side of said desk;

said, an elongate inner support arm channel having a generally square U-shaped transverse cross section sized to be nested vertically within said outer channel member in opposed facing relation in a stored position, and having a first end pivotally connected with an upper end of said outer channel member and a second end pivotal outwardly and upwardly from said outer channel member in said to an outwardly extended position disposed horizontally a distance above the surface of a floor;

a seat secured to said support arm channel second end; and an elongate support member nested vertically within said support arm channel in a stored position, having a first end pivotally connected with said second end of said support arm channel and having a second end pivotal outwardly and downwardly from said support arm member to an outwardly extended vertical position;

in the stored position, said support leg member disposed vertically inside said support arm channel and said support arm channel disposed vertically inside said outer channel member; and to deploy said seat attachment, said second end of said support arm channel and said seat is pivoted upwardly to assume a horizontal position perpendicular to said outer channel member, and said second end of said support leg is pivoted outwardly and downwardly from said support arm channel to assume a vertical position perpendicular to said support arm channel.

8. The desk according to claim 7, further comprising:

torsion spring means connected between said support leg member and said support arm channel to urge said support leg second end to pivot outwardly and downwardly about the pivotal connection of its said first end with said support arm channel as said support arm channel is pivoted upwardly to assume a horizontal position.

9. The desk according to claim 7, further comprising:

foldable brace means having opposed ends connected between said support leg member and said support arm channel and movable between a folded position generally parallel with said support leg member and said support arm channel in their stored position and an unfolded position extending generally diagonally therebetween in their deployed position to releasably lock and brace said support leg member in a position perpendicular to said support arm channel.

10. A desk having a seat attachment on a side of the desk with a seat movable between a stored position closely adjacent to the side of the desk and a deployed position to provide an auxiliary seating surface comprising:

a desk having at least one side and supported on a floor surface;

an elongate generally rectangular outer tubular member having a generally square transverse cross section disposed horizontally on said side of said desk with an open end perpendicular to said side of said desk;

an elongate inner support arm channel halving a generally square U-shaped transverse cross section received within said outer tubular member in a stored position with an open side facing downwardly, and slidable a distance outwardly relative thereto to an outwardly extended position disposed horizontally a distance above the surface of a floor;

a seat pivotally connected to an outwardly extensible end of said support arm channel to pivot between a generally vertical position and a horizontal deployed position; and an elongate support leg member nested generally horizontally within said support arm channel in said stored position, having a first end pivotally connected with said support arm channel and having a second end pivotal outwardly and vertically downwardly from and generally perpendicular to said support arm channel in its said outwardly extended position to engage a floor surface and support said support arm channel and said seat a distance above the surface of the floor;

in the stored position, said support leg member disposed horizontally inside said support arm channel and said support arm channel disposed horizontally inside said outer tubular member; and to deploy said seat attachment, said support arm channel and said seat is pulled outwardly a distance from said outer tubular member to assume a horizontal position coaxial with said outer tubular member, said second end of said support leg member is pivoted outwardly and downwardly from said support arm channel to assume a vertical position perpendicular to said support arm channel, and said seat is pivoted from its generally vertical position to its horizontal deployed position.

11. The desk according to claim 10, wherein said seat is pivotally connected to said outwardly extensible end of said support arm channel by hinge means; and said support arm channel has a slot extending longitudinally from its said open end configured to slidably accommodate said hinge means when said support arm channel is received within said outer tubular member in said stored position.

* * * * *